United States Patent [19]

Yoshitomi

[11] Patent Number: 4,772,022

[45] Date of Patent: Sep. 20, 1988

[54] APPARATUS FOR STOPPING THE REELS OF A SLOT MACHINE

[75] Inventor: Taihei Yoshitomi, Tokyo, Japan

[73] Assignee: Kabushiki Kaisha Universal, Tochigi, Japan

[21] Appl. No.: 899,959

[22] Filed: Aug. 25, 1986

[30] Foreign Application Priority Data

Aug. 23, 1985 [JP] Japan ..... 60-128595[U]

[51] Int. Cl.[4] ..... A63F 7/00

[52] U.S. Cl. ..... 273/143 R; 318/685

[58] Field of Search ..... 273/143 R, 138 A; 318/685

[56] References Cited

U.S. PATENT DOCUMENTS 4,481,454 11/1984 Otami ..... 318/685

4,513,236 4/1985 Kikukawa et al. ..... 318/685

4,657,256 4/1987 Okada ..... 273/143 R

*Primary Examiner*—Maryann Lastova

*Attorney, Agent, or Firm*—Young & Thompson

[57] ABSTRACT

An apparatus for stopping a reel of a slot machine is provided, wherein the reel is rotated by a stepping motor which is driven with multi-phase drive pulses sequentially offset in phase. The apparatus includes a stop signal generator for generating a stop signal to be used for stopping the reel and a stop pulse generator circuit for simultaneously supplying stop pulses of the same phase to respective phases of the stepping motor to which the drive pulses are supplied. All of the respective phases of the motor are simultaneously magnetically excited responsive to the stop pulses received by the stepping motor.

8 Claims, 2 Drawing Sheets

APPARATUS FOR STOPPING THE REELS OF A SLOT MACHINE

BACKGROUND OF THE INVENTION

The present invention relates to an apparatus for instantaneously stopping a reel of a slot machine driven in rotation by a stepping motor.

In a slot machine, for example, a three-reel type slot machine, a player can attempt to win a game by stopping each of the three reels, on the periphery of which symbols such as pictures or numerals are disposed, as they rotate at a high speed, so as hopefully to obtain a desired combination of the symbols at the present window position. Nowadays, it is common to rotate reels by means of stepping motors. Since the determination of the stopped symbols at the preset window position can be made based on the number of drive pulses supplied to the respective stepping motors during rotation thereof, this is a very convenient practice. In slot machines of this type, stopping of the reels is generally effected by terminating the supply of drive pulses to the stepping motors.

Moreover, multi-phase drive pulses are commonly used in the art to drive stepping motors. For instance, when using a two-phase drive energization circuit and generating therefrom four-phase drive pulses, drive pulses each offset in phase by 90 degrees are sequentially supplied to the stepping motor to drive it. To stop the stepping motor, the frequency of drive pulses supplied to each phase is gradually reduced from the time when a stop signal is generated, ultimately to terminate the supply of drive pulses to each phase.

In stopping the stepping motor in the above manner, it is a fairly long time from when the stop signal is generated to when the reel stops. Therefore, in a slot machine of the type generating a stop signal responsive to manipulation of a stop button by the player, the time when the stop button is manipulated is perceptibly different from the time when the reel actually stops, thereby detracting from the player's belief that he may accurately control the machine. Thus the time lag between manipulation of the stop button the actual reel stop page must be as short as possible.

OBJECT OF THE INVENTION

The present invention has been made in view of the above-described technical background, and it is an object of the present invention to provide an apparatus for quickly stopping a reel of a slot machine after a stop signal is generated.

SUMMARY OF THE INVENTION

The above object of the present invention is achieved by providing an apparatus for stopping a reel of a slot machine wherein drive pulses each offset in phase are supplied to a multi-phase drive type stepping motor and, responsive to the generation of a stop signal, stop pulses all having the same polarity are simultaneously supplied to all of the phases of the stepping motor to stop it instantaneously. It is desirable in this case to intercept the supply of drive pulses to each phase of the stepping motor at the time of stop signal generation.

BRIEF DESCRIPTION OF THE DRAWINGS

Other objects and advantages of the invention will become apparent from the following description with reference to the accompanying drawings, wherein.

DETAILED DESCRIPTION OF THE INVENTION

Figure 1:
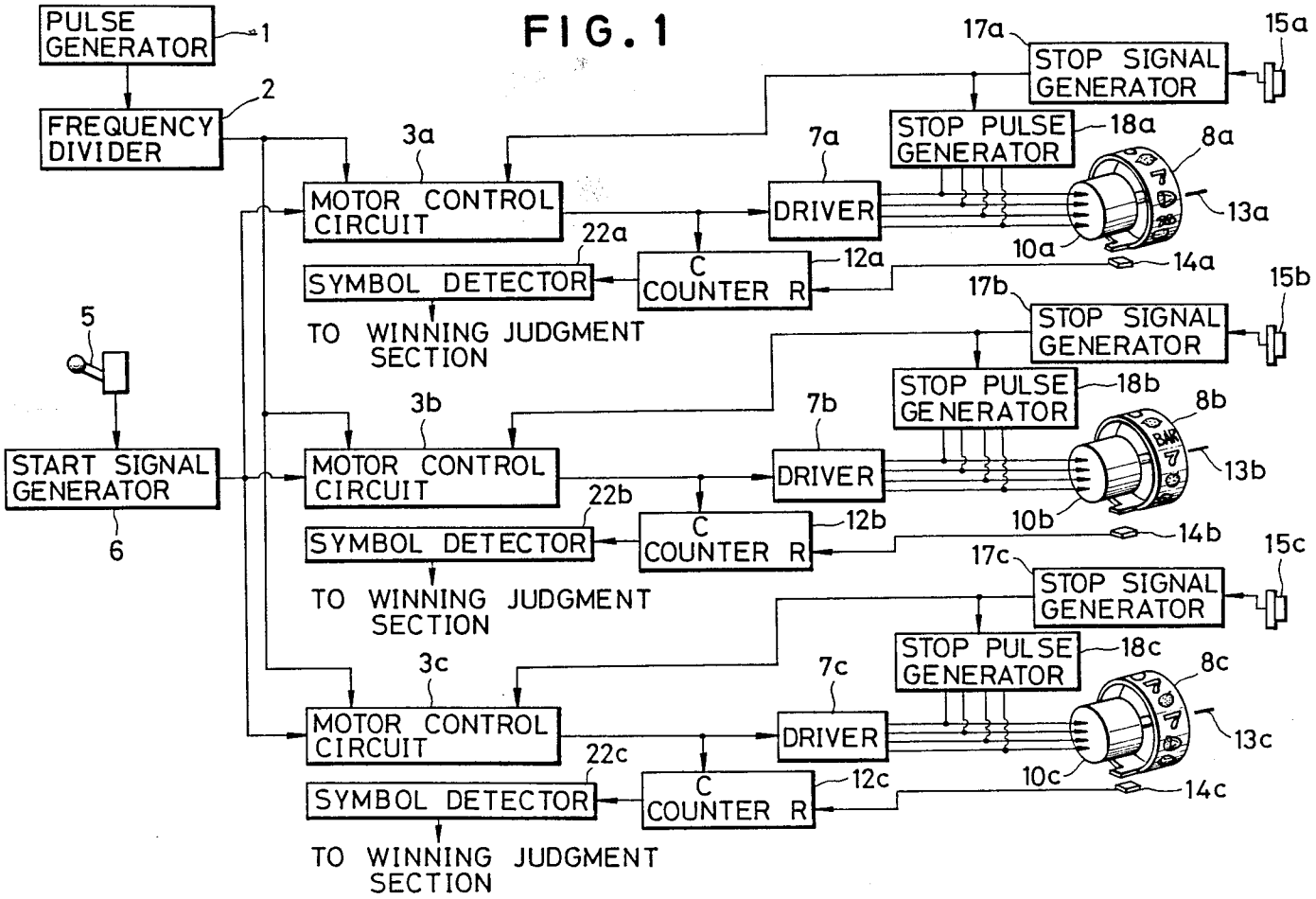
FIG. 1 is a block diagram showing a circuit arrangement of a slot machine comprising the present invention.

Referring now to FIG. 1 showing the circuit arrangement of a slot machine comprising the present invention, a pulse generator 1 generates clock pulses of a predetermined frequency. The clock pulses are frequency-divided by a frequency divider 2 to obtain a predetermined frequency. Thereafter, they are supplied to motor control circuits 3*a* to 3*c* individual to corresponding reel 8*a* to 8*c*. When a start lever 5 is operated by the player for starting a game, a start signal is generated from a start signal generator 6 and the motor control circuits 3*a* to 3*c*, each having the same circuit construction, are actuated. Then, main drive pulses are output from the motor control circuits 3*a* to 3*c* in accordance with the clock pulses from the frequency divider 2, and supplied to the corresponding drivers 7*a* to 7*c*.

Figure 2:
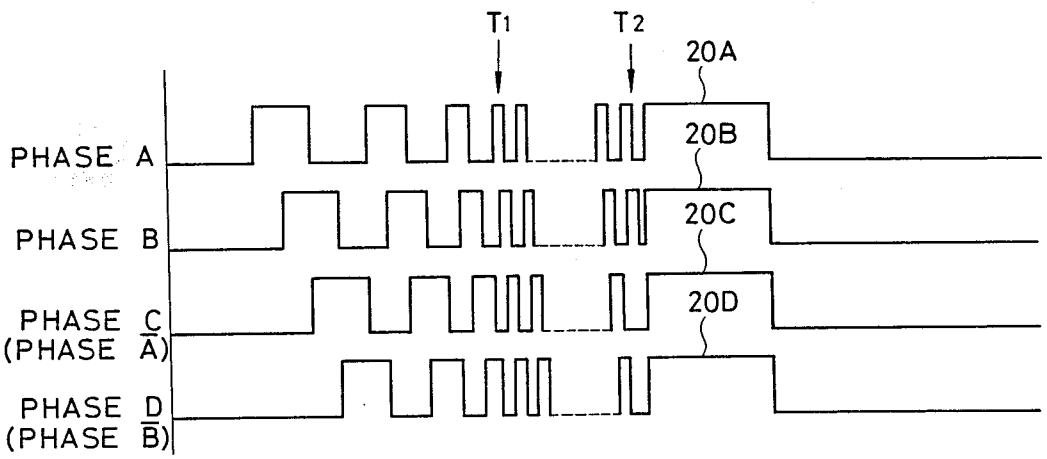
FIG. 2 is a timing chart showing the drive and stop pulses supplied to the stepping motor.

The drivers 7*a* to 7*c* then drive corresponding four-phase drive type stepping motor 10*a* to 10*c* which in turn initiate rotation of the reels 8*a* to 8*c*. To this end, the drivers 7*a* to 7*c* which receive master drive pulses from the motor control circuits 3*a* to 3*c* supply four-phase drive pulses, i.e. phase A to phase D, each offset in phase by 90 degrees as shown in FIG. 2, to the corresponding stepping motors 10*a* to 10*c*. As will be seen in FIG. 2, from the onset of driving the stepping motors 10*a* to 10*c*, the frequency of the master drive pulses from the motor control circuits 3*a* to 3*c* gradually increases until it reaches a constant frequency. Consequently, the drive pulses as shown in FIG. 2 are outputted from the drivers 7*a* to 7*c* and supplied to the stepping motors 10*a* to 10*c*.

The master drive pulses from the motor control circuits 3*a* to 3*c* are respectively counted by counters 12*a* to 12*c*. Since the number of master drive pulses per rotation of each reel and the number of symbols disposed on each reel are constant, it is possible to identify which symbols, if any, of the reels 8*a* to 8*c* are positioned on winning lines 13*a* to 13*c* based on the respective counts of the counters 12*a* to 12*c*. In this case, each time a reel 8*a* to 8*c* rotates once, a reset signal is outputted from a corresponding photosensor 14*a* to 14*c* to reset the count of the corresponding counter 12*a* to 12*c*.

The reels 8*a* to 8*c* are rotating at full speed by time T1 of FIG. 2 and only then can the player actuate stop bottons 15*a* to 15*c*. Upon actuation of stop button 15*a* at time T2, a stop signal is outputted from a stop signal generator 17*a*. This stop signal is inputted to the motor control circuit 3*a* to disable it so that master drive pulses are no longer supplied to the driver 7*a*, thereby also preventing the supply of drive pulses to the stepping motor 10*a*.

Simultaneously therewith, a stop pulse generator 18*a* is actuated by the stop signal from the stop signal generator 17*a*. Consequently, as shown in FIG. 2, stop pulses 20A to 20D all having the same phase and pulse width relative to each other are simultaneously supplied to all of phases A to D of the stepping motor 10*a*. Thus, all the phases of the stepping motor 10a become magnetically excited to terminate instantaneously the driving of the stepping motor 10*a*. By these means, the position of the rotor of the stepping motor 10*a* is regulated by electromagnetic force, thus preventing this rotor vibrating. For this same reason, the reel 8*a* fixed to the rotor of the stepping motor 10*a* is not subject to vibration at the time of stoppage of the motor, and hence the symbol disposed on the periphery thereof and positioned on the winning line 13*a* is not subject to sway.

By operating the stop buttons 15*b* and 15*c*, the remaining reels 8*b* and 8*c* are also stopped in the manner described above. As described previously, when the main drive pulses are no longer supplied by the motor control circuits 3*a* to 3*c*, the respective counts of the counters 12*a* to 12*c* remain unchanged. The counts at that time are loaded in symbol detectors 12*a* to 12*c* to indentify the corresponding symbol codes of the respective symbols positioned on the winning lines 13*a* to 13*c*. A combination of the symbol codes thus obtained is judged in a winning judgment section (not shown). In case of a win, a predetermined number of coins or tokens are paid out and the game is complete.

In the above embodiment, a stop signal is generated responsive to actuation of a stop button 15*a* to 15*c*. However, the apparatus of the present invention for stopping a reel of a slot machine is also applicable to machines in which the reels are stopped automatically. In machines of this type, a stop signal is generated automatically by means of, for example, a random timer. When the present invention is applied to such a machine, the reels are always stopped in order and the symbols on the winning lines are not subject to displacement or sway. Moreover, the count of the counter in this case is kept constant after generation of the stop signal by preventing master drive pulses from being output by the motor control circuit. However, the count may be held merely by stopping the supply of master drive pulses to the counter alone.

As is clear the foregoing description of the present invention of an apparatus for stopping a reel of a slot machine, stop pulses of the same phase are simultaneously supplied to all of the phases of a multi-phase drive type stepping motor which rotates a reel. Therefore, it is possible to stop the reel in a stable and almost instanteous manner, thus ensuring the desired stop position of a symbol relative to a winning line.

Having described the invention in relation to the embodiment shown in the accompanying drawings, it is intended that the invention not be limited by any of the details of description, unless otherwise specified, but rather be construed broadly within its spirit and scope as set out in the accompanying claims.

What is claimed is:

1. In a slot machine of the type having a stepping motor driven by multi-phase drive pulses sequentially offset in phase received at corresponding phases of said motor, means for generating said pulses operatively connected to said motor, a reel driven by said motor, and means for generating stop signals for stopping said reel, the improvement comprising: means for generating stop pulses responsive to a said stop signal and supplying said stop pulses to said corresponding phases of said motor, said stop pulses all having the same phase relative to each other; whereby all said corresponding phase of said motor are simultaneously magnetically excited responsive to said stop pulses received by said motor.

2. Slot machine according to claim 1, and means for terminating said drive pulses supplied to said stepping motor from said pulse generating means responsive to a said stop signal.

3. Slot machine according to claim 1, wherein said stop signal generating means comprises a player-actuated stop button for actuating said stop signal generating means.

4. Slot machine according to claim 1, said stop pulses all having the same pulse width.

5. An apparatus for stopping a reel of a slot machine comprising:

a multi-phase stepping motor having respective phases, for rotating said reel;

means for generating a stop signal;

a driver adapted to be responsive to master drive pulses supplied from a motor control circuit, said driver generating and supplying multi-phase drive pulses to said respective phases of said stepping motor;

stop pulse generator means for simultaneously supplying, responsive to a said stop signal, stop pulses to said respective phase of said motor, said stop pulses having all the same phase, thereby simultaneously and magnetically to excite all of said respective phases of said stepping motor and stop the rotation of said stepping motor;

a counter for counting said master drive pulses supplied from said motor control circuit;

and means for indentifying the position of a symbol disposed on the periphery of said reel responsive to said counter.

6. An apparatus for stopping a reel of a slot machine according to claim 5, and means for supplying a said stop signal to said motor control circuit for terminating said supply of master drive pulses to said driver and said counter.

7. An apparatus for stopping a reel of a slot machine according to claim 5, wherein said stop signal generating means comprises a player-actuated stop button for actuating said stop signal generating means.

8. Slot machine according to claim 5, said stop pulses all having the same pulse width.

* * * * *